US011986701B2

(12) United States Patent
Belson et al.

(10) Patent No.: US 11,986,701 B2
(45) Date of Patent: May 21, 2024

(54) STRENGTH CALIBRATION

(71) Applicant: Tonal Systems, Inc., San Francisco, CA (US)

(72) Inventors: Brandt Belson, San Francisco, CA (US); Kelly Savage, Los Angeles, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

(21) Appl. No.: 18/138,630

(22) Filed: Apr. 24, 2023

(65) Prior Publication Data

US 2023/0256299 A1 Aug. 17, 2023

Related U.S. Application Data

(63) Continuation of application No. 17/101,655, filed on Nov. 23, 2020, which is a continuation of application No. 16/276,377, filed on Feb. 14, 2019, now Pat. No. 10,874,905.

(51) Int. Cl.

| | |
|---|---|
| ***A63B 24/00*** | (2006.01) |
| ***A63B 21/002*** | (2006.01) |
| ***A63B 23/04*** | (2006.01) |

(52) U.S. Cl.

CPC ..... *A63B 24/0087* (2013.01); *A63B 21/002* (2013.01); *A63B 23/047* (2013.01); *A63B 24/0062* (2013.01); *A63B 2024/0065* (2013.01); *A63B 2024/0093* (2013.01)

(58) Field of Classification Search

CPC ..... A63B 24/0087; A63B 24/0062; A63B 21/002; A63B 23/047; A63B 2024/0065; A63B 2024/0093; A63B 21/0059; A63B 2220/10; A63B 2220/51; A63B 2220/54; A63B 2220/58; A63B 2220/80; A63B 2220/803; A63B 2220/805; A63B 2220/833

See application file for complete search history.

(56) References Cited

U.S. PATENT DOCUMENTS

| | | | | | |
|---|---|---|---|---|---|
| 80,289 | A | * | 7/1868 | Leavitt | A47B 3/06 108/158.12 |
| 4,869,497 | A | * | 9/1989 | Stewart | A63B 24/0006 482/901 |
| 4,919,418 | A | * | 4/1990 | Miller | A63B 21/151 482/901 |
| 5,230,672 | A | * | 7/1993 | Brown | A63B 21/154 482/4 |

(Continued)

FOREIGN PATENT DOCUMENTS

| | | |
|---|---|---|
| WO | 2015139089 | 9/2015 |

*Primary Examiner* — Garrett K Atkinson

(74) *Attorney, Agent, or Firm* — Van Pelt, Yi & James LLP

(57) ABSTRACT

A resistance force is controlled such that a user's effort against the resistance force results in a first isokinetic seed movement. The resistance force required to effect the first isokinetic seed movement is associated with a force-velocity profile. It is determined whether a sufficient number of isokinetic seed movements have been performed by the user. In response to a determination that the sufficient number of isokinetic seed movements have been performed by the user, a strength determination of the user is made based on the isokinetic seed movements performed by the user.

20 Claims, 5 Drawing Sheets

(56) References Cited

U.S. PATENT DOCUMENTS 5,254,066 A * 10/1993 Brown ..... A63B 24/0062 601/40
5,362,298 A * 11/1994 Brown ..... A63B 24/0062 601/40
5,407,402 A * 4/1995 Brown ..... A63B 21/154 482/4
5,919,115 A * 7/1999 Horowitz ..... A63B 21/00181 482/901
6,280,361 B1 * 8/2001 Harvey ..... A63B 24/00 482/4
6,837,830 B2 * 1/2005 Eldridge ..... A63B 23/047 482/54
7,967,728 B2 * 6/2011 Zavadsky ..... A63F 13/28 482/901
8,287,434 B2 * 10/2012 Zavadsky ..... A63B 21/00 482/901
8,900,099 B1 * 12/2014 Boyette ..... A63B 71/0619 482/901
9,731,157 B2 * 8/2017 Loach ..... A63B 21/0053
2004/0087418 A1 * 5/2004 Eldridge ..... A63B 69/0022 482/54
2006/0224087 A1 * 10/2006 Holder ..... A61B 5/224 600/587
2007/0202992 A1 * 8/2007 Grasshoff ..... A63B 24/00 482/8
2010/0069202 A1 * 3/2010 Olsen ..... A63B 21/0058 482/92
2010/0125026 A1 * 5/2010 Zavadsky ..... A63F 9/24 482/5
2011/0251021 A1 * 10/2011 Zavadsky ..... A63F 13/28 482/5
2013/0065680 A1 * 3/2013 Zavadsky ..... A63F 13/211 463/30
2014/0113779 A1 * 4/2014 Loach ..... A63B 21/00069 310/105
2015/0066170 A1 * 3/2015 Harris ..... G09B 19/0038 700/91
2016/0158603 A1 * 6/2016 Darwood ..... A63B 24/0062 482/5
2017/0080289 A1 * 3/2017 Hashish ..... A63B 21/045
2017/0282015 A1 * 10/2017 Wicks ..... A63B 24/0075
2018/0001181 A1 * 1/2018 von Prellwitz .... A63B 24/0075
2018/0021616 A1 * 1/2018 Orady ..... A63B 21/153 482/5
2019/0111316 A1 * 4/2019 Su ..... A61B 5/224
2020/0047027 A1 2/2020 Ward
2020/0047030 A1 2/2020 Ward
2020/0047053 A1 2/2020 Ward
2020/0047054 A1 2/2020 Ward
2020/0047055 A1 2/2020 Ward
2020/0054929 A1 2/2020 Ward

* cited by examiner

STRENGTH CALIBRATION

CROSS REFERENCE TO OTHER APPLICATIONS

This application is a continuation of U.S. patent application Ser. No. 17/101,655, entitled STRENGTH CALIBRATION filed Nov. 23, 2020, which is a continuation of U.S. patent application Ser. No. 16/276,377, now U.S. Pat. No. 10,874,905, entitled STRENGTH CALIBRATION filed Feb. 14, 2019, each of which is incorporated herein by reference for all purposes.

BACKGROUND OF THE INVENTION

Strength training may be a poorly understood activity for a strength training user. One aspect of this is lack of-knowledge about the level of one's own strength. When beginning a strength training regimen, users are often at a loss as to what weight levels to choose for a given movement.

BRIEF DESCRIPTION OF THE DRAWINGS

Various embodiments of the invention are disclosed in the following detailed description and the accompanying drawings.

DETAILED DESCRIPTION

Figure 1:
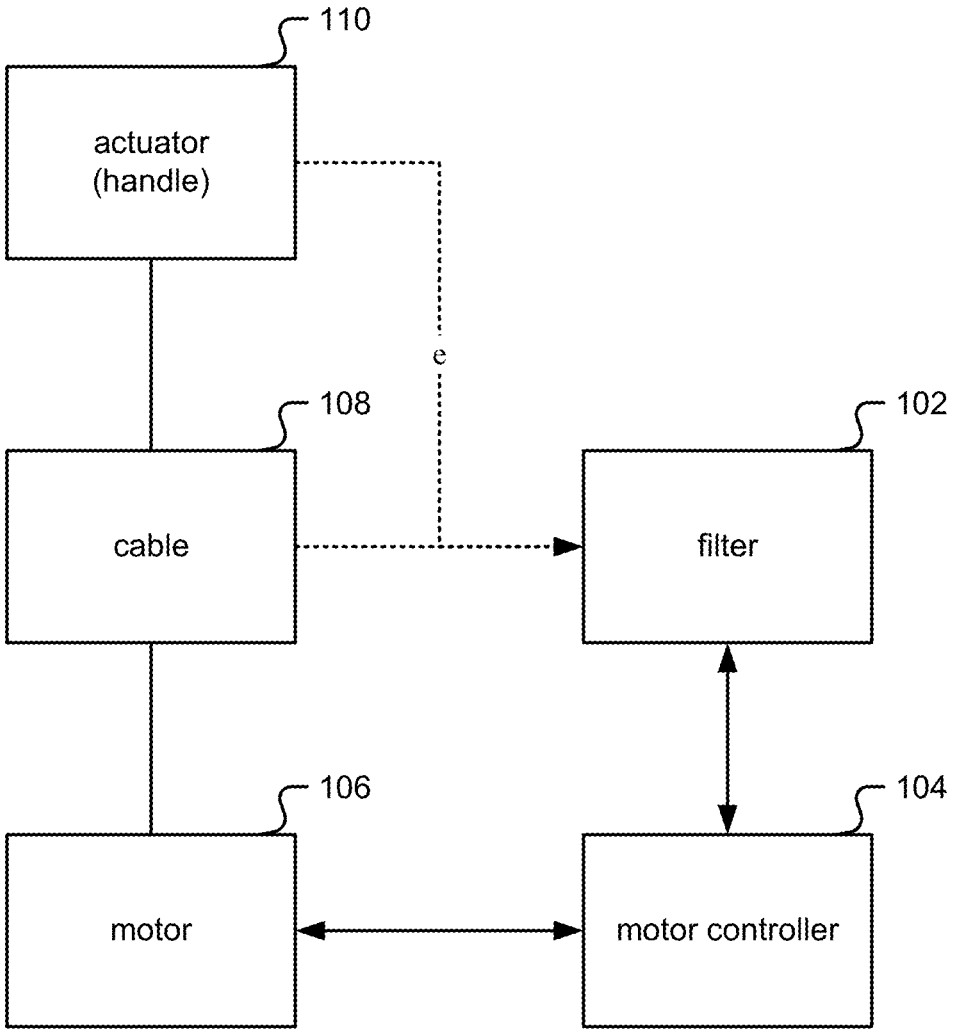
FIG. 1 is a block diagram illustrating an embodiment of an exercise machine capable of digital strength training.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Strength determination of a user based on only a few specific movements is disclosed. This strength determination may be used as a starting basis for a strength level for the user for hundreds of strength training movements, for getting a user started on a strength training machine, and/or for calibrating progress. The strength determination is based at least in part on an "isokinetic seed movement". An isokinetic seed movement as referred to herein is a movement wherein the user is allowed to move against a machine's resistance at a prescribed constant speed during a movement's concentric, or eccentric, phase, and the machine's resistance dynamically changes to match the user's applied force. The user's produced force at the prescribed speed is mapped to a predetermined force-velocity profile/plot ("FVP") to determine strength, for example an estimated one rep maximum ("1eRM") for the user for the muscle group associated with the isokinetic seed movement, wherein the 1eRM is an estimate of the one rep maximum, or how much weight a user could maximally exercise for a given movement for a single cycle, that is without further repetition. This 1eRM may be used to recommend starting weights for future non-isokinetic movements, for example regular strength training movements.

Traditionally, one method of calibrating a user's strength is to ask a user to perform one or more movements, and do so to the point of physical failure. However, this approach is manual, painful to users, and may even injure some users. An improvement of the disclosed is the providing of an automated way of calibrating a user's strength level that additionally reduces a risk of injury for the user.

The disclosed techniques may be used with any machine capable of these, or other, isokinetic seed movements, for example using a digital strength training technique as described in U.S. Provisional Patent Application No. 62/366,573 entitled METHOD AND APPARATUS FOR DIGITAL STRENGTH TRAINING filed Jul. 25, 2016 and U.S. patent application Ser. No. 15/655,682 entitled DIGITAL STRENGTH TRAINING filed Jul. 20, 2017, which are incorporated herein by reference for all purposes. Any person of ordinary skill in the art understands that the strength determination techniques may be used without limitation with other machines capable of isokinetic seed movements, and the digital strength trainer is given merely as an example embodiment.

FIG. 1 is a block diagram illustrating an embodiment of an exercise machine capable of digital strength training. The exercise machine includes the following:

a controller circuit (104), which may include a processor, inverter, pulse-width-modulator, and/or a Variable Frequency Drive (VFD); circuit;

a motor (106), for example a three-phase brushless DC driven by the controller circuit;

a spool with a cable (108) wrapped around the spool and coupled to the spool. On the other end of the cable an actuator/handle (110) is coupled in order for a user to grip and pull on. The spool is coupled to the motor (106) either directly or via a shaft/belt/chain/gear mechanism. Throughout this specification, a spool may be also referred to as a "hub";

a filter (102), to digitally control the controller circuit (104) based on receiving information from the cable (108) and/or actuator (110);

optionally (not shown in FIG. 1) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;

one or more of the following sensors (not shown in FIG. 1): a position encoder; a sensor to measure position of the actuator (110). Examples of position encoders include a hall effect shaft encoder, grey-code encoder on the motor/spool/cable (108), an accelerometer in the actuator/handle (110), optical sensors, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;

a motor power sensor; a sensor to measure voltage and/or current being consumed by the motor (106);

a user tension sensor; a torque/tension/strain sensor and/or gauge to measure how much tension/force is being applied to the actuator (110) by the user. In one embodiment, a tension sensor is built into the cable (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In one embodiment, a three-phase brushless DC motor (106) is used with the following:

- a controller circuit (104) combined with filter (102) comprising:
  - a processor that runs software instructions;
  - three pulse width modulators (PWMs), each with two channels, modulated at 20 kHz;
  - six transistors in an H-Bridge configuration coupled to the three PWMs;
  - optionally, two or three ADCs (Analog to Digital Converters) monitoring current on the H-Bridge; and/or
  - optionally, two or three ADCs monitoring back-EMF voltage;
- the three-phase brushless DC motor (106), which may include a synchronous-type and/or asynchronous-type permanent magnet motor, such that:
  - the motor (106) may be in an "out-runner configuration" as described below;
  - the motor (106) may have a maximum torque output of at least 60 Nm and a maximum speed of at least 300 RPMs;
  - optionally, with an encoder or other method to measure motor position;
- a cable (108) wrapped around the body of the motor (106) such that entire motor (106) rotates, so the body of the motor is being used as a cable spool in one case. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or
- an actuator (110) such as a handle, a bar, a strap, or other accessory connected directly, indirectly, or via a connector such as a carabiner to the cable (108).

In some embodiments, the controller circuit (102, 1004) is programmed to drive the motor in a direction such that it draws the cable (108) towards the motor (106). The user pulls on the actuator (110) coupled to cable (108) against the direction of pull of the motor (106).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (106).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (110) coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, note a distinction between the direction the motor (106) is pulling, and the direction the motor (106) is actually turning.

If the controller circuit (102, 1004) is set to drive the motor (106) with, for example, a constant torque in the direction that spools the cable, corresponding to the same direction as a weight stack being pulled towards the ground, then this translates to a specific force/tension on the cable (108) and actuator (110). Calling this force "Target Tension", this force may be calculated as a function of torque multiplied by the radius of the spool that the cable (108) is wrapped around, accounting for any additional stages such as gear boxes or belts that may affect the relationship between cable tension and torque. If a user pulls on the actuator (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and moves towards the motor (106), being the virtual equivalent of the weight stack returning.

BLDC Motor. While many motors exist that run in thousands of revolutions per second, an application such as fitness equipment designed for strength training has different requirements and is by comparison a low speed, high torque type application suitable for a BLDC motor.

In one embodiment, a requirement of such a motor (106) is that a cable (108) wrapped around a spool of a given diameter, directly coupled to a motor (106), behaves like a 200 lbs weight stack, with the user pulling the cable at a maximum linear speed of 62 inches per second. A number of motor parameters may be calculated based on the diameter of the spool.

| User Requirements | | | | |
|---|---|---|---|---|
| Target Weight | 200 | lbs | | |
| Target Speed | 62 | inches/sec = | 1.5748 | meters/sec |

| Requirements by Spool Size | | | | | | |
|---|---|---|---|---|---|---|
| | Diameter (inches) | | | | | |
| | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor speed and/or motor position as with BLDC motors is more appropriate for fitness equipment/strength training systems.

Figure 2:
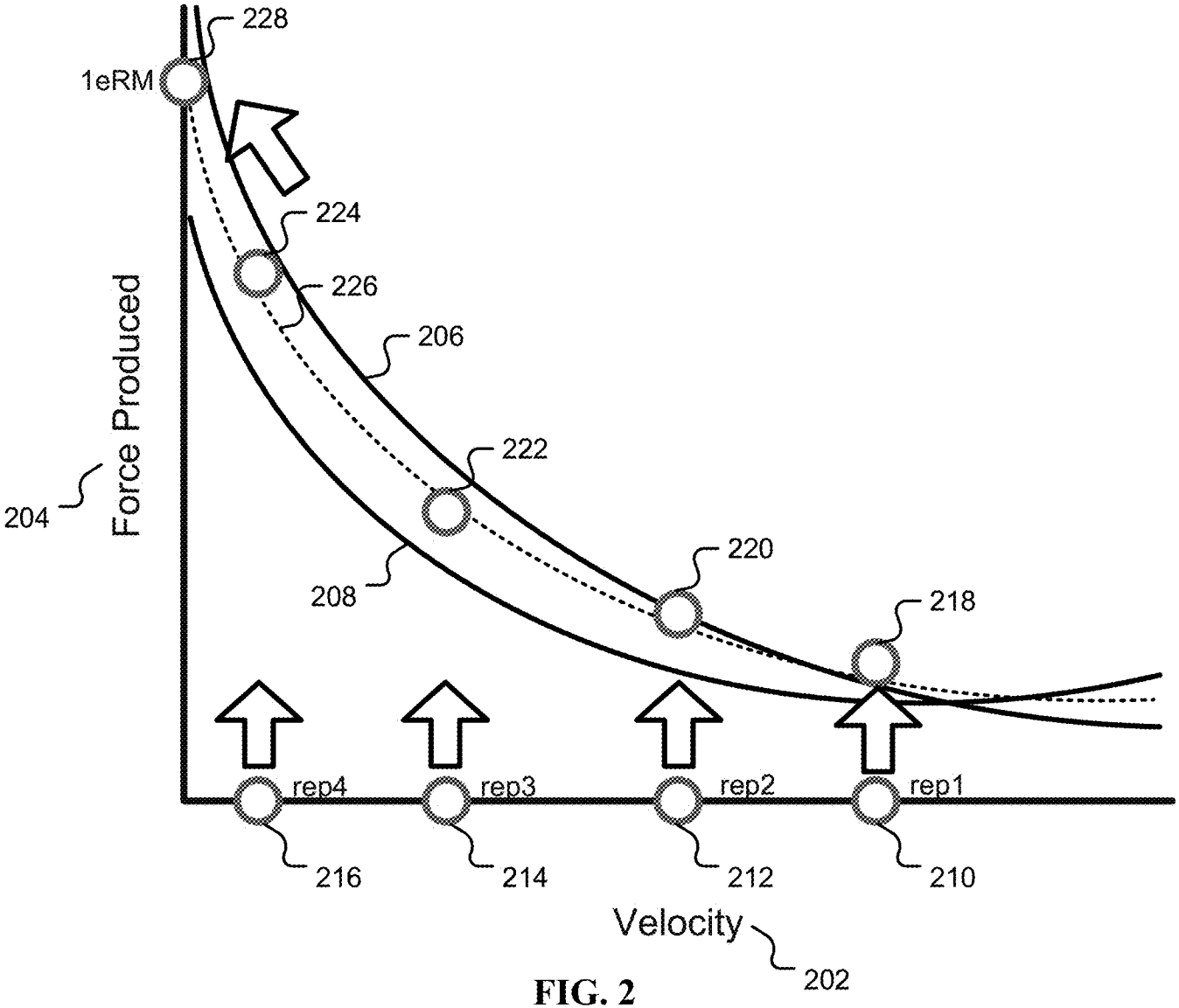
FIG. 2 illustrates an example of strength determination based on isokinetic seed movements.

FIG. 2 illustrates an example of strength determination based on isokinetic seed movements. FIG. 2 is a two-dimensional with an x-axis along movement velocity (202) and a y-axis along force produced (204) for that movement. For a given movement, using empirical studies one or more theoretical FVPs (206), (208) may be plotted in general for a typical human being in general, or for a typical human being of a given age, sex, and/or other demographic/physical characteristics.

Using the machine of FIG. 1, the machine prompts and manifests isokinetic seed movements for the user to perform. At least one isokinetic seed movement is needed to determine strength, and practically 3-4 of the same isokinetic seed movement at different speeds may be used to determine strength with greater accuracy. As well, 3-4 different isokinetic seed movements may be used to determine strength for different muscle groups.

From data gathered on these isokinetic seed movements, the maximum weight may be estimated as a 1eRM for the user for movements associated with the isokinetic seed movements performed in a normal, non-isokinetic way, for example smoothly concentric and eccentric. That maximum weight may be used to estimate proper weight for multiple repetitions ("reps"), for example 10 reps or 15 reps, of the associated movement in normal/everyday exercise.

In one embodiment, the same data for a few isokinetic seed movements may be used to recommend starting weight for a broad selection of movements that are not necessarily the isokinetic seed movements. In one embodiment, an ongoing recalibration of the strength determination is done without requiring the user to repeat the isokinetic seed movements; instead, the user's performance on each movement is used to update a user's strength level determination.

In the example shown, the machine of FIG. 1 prompts and/or demonstrates to the user how to use the handles and/or attachments (110) to perform an isokinetic seed movement. The machine may manifest three or four isokinetic seed movements for the user to perform. In one embodiment, the machine uses video prompts on a monitor, and for the isokinetic seed movement, the user mimics what they see in the video and are instructed to move the actuator (110) as fast and as powerfully as they possibly can. The machine's resistance dynamically changes to match the user's applied force, while allowing the user to move the resistance at a prescribed constant speed during the concentric phase, establishing for a given speed (210), for example 50 inches/second, a corresponding produced force (218).

The movements are selected to evaluate different muscle groups in the body, and primarily are aimed at lower body, upper body pushing, upper body pulling, and core, and to be easy to perform with proper form and low risk of injury. In one embodiment, the movements used are a seated lat pulldown, a seated overhead press, a bench press, and a neutral grip deadlift. In another embodiment, the movements used exclude bench press or could replace bench press with a movement that focuses on core/abdominal motion.

The machine generates data from these isokinetic seed movements. In one embodiment, at 50 hz, the machine adjusts the force needed to match the user and maintain a constant prescribed speed. In one embodiment, speed is varied between 20-60 inches/second, decreasing each rep. This time series data is stored during the reps in memory and also to log files that may be stored locally and/or in the cloud with an account associated with the user.

In one embodiment, a second rep of the isokinetic seed movement is performed after an appropriate rest, for example at 45 inches/second (212) a second produced force (220) is established. In one embodiment, a third rep of the isokinetic seed movement is performed after an appropriate rest, for example at 35 inches/second (214) a third produced force (222) is established. In one embodiment, a fourth rep of the isokinetic seed movement is performed after an appropriate rest, for example at 30 inches/second (216) a fourth produced force (224) is established.

With one data point (218) or more (220, 222, 224) data points, a FVP (226) may be estimated for the user. This FVP (226) may intercept the y-axis at point (228), which represents the 1eRM of the user.

Thus with at least one isokinetic seed movement, and practically with 3-4 reps of an isokinetic seed movement at varying speeds, by comparing an amount of force resisted at each given velocity, extrapolation may permit a slope to be drawn and an 1eRM determination is made based on the drawn slope. With the 1eRM, with traditional repetition values associated with specific percentages of a 1eRM, recommendations may be made for different weights.

The machine determines user's strength level from at least one and practically with 3-4 isokinetic seed movements on the machine. The force and speed time series data stored during the reps may be used to find the 1eRM the user could perform at each movement. In one embodiment, noise is first removed from sensor measurements. For example, smart average-like values of the speed at which the user acted against the force of resistance are found based at least in part on historical data for a particular machine with its inherent friction/sensor noise and/or for a particular user with their anatomical and physiological past history.

The velocity and force pair determine a one rep maximum that the user can lift, using a traditional relationship/tradeoff between how much force and velocity the human body can generate as shown in FIG. 2, when isokinetic force has been historically observed/studied to determine specific FVP for a movement. The 1eRM is the force at a speed of approximately zero in an FVP. The FVP relationship is based on data collected from many users for each movement, as the relationship varies for each different movement. Using the velocity and force pair the user performed, the 1eRM (228) may be found by following along the FVP (226) to a near-zero velocity. In one embodiment, the user's best result is taken should they try the entire process multiple times.

Once a 1eRM has been calculated, respective rep/weight recommendations may be made based on traditional "rep-percentage" charts which are known in the field to equate a 1eRM to a suggested weight for 10 reps, for example. Practical adaptation includes a suitable attenuation of a recommendation for practical reasons, for example recommending using the rep-percentage charge based on specific rep or percentages may naively recommend a user "do 10 reps at 75% of their 1eRM". This would rate these reps at 9-10 out of 10 on a relative perceived exertion scale and physically the user may not be able to replicate the recommendation across multiple sets. Knowing this, the scale may be attenuated by 10-15% and then those values equated to accommodate physiological fatigue. A final suggestion based on a 1eRM determination may be to "do 10 reps at (60%) of 1eRM", which is still personalized to the user and accounts for fatigue across multiple sets, say 4-6 sets.

In one embodiment, using isokinetic seed movements of seated lat pulldown, a seated overhead press, a bench press, and a neutral grip deadlift, the list of movements with a starting strength determination and rep suggestion may be extrapolated to include those in Table 1 below:

TABLE 1

Extrapolated movements available from seed movement.

| | | |
|---|---|---|
| ½ Kneeling Pallof Press | Inline Stability Chop | Iso Split Squat Stability Lift |
| ½ Kneeling Stability Chop | Inline Stability Lift | Kneeling Cable Crunch |
| ½ Kneeling Stability Lift | Iso Split Squat Pallof Press | Lateral Bridge w/ Row |
| Bird Dog w/Row | Iso Split Squat Stability Chop | Pillar Bridge w/ Arm Overhead Press |
| Row | Lunge | ½ Kneeling Single Arm Row |
| Pullover Crunch | Goblet Split Squat | Alternating Bench Press |
| Rotational Chop | Goblet Squat | Alternating Neutral Lat Pulldown |
| Rotational Lift | Neutral Grip Deadlift | Barbell Bent Over Row |
| Single Leg Pallof Press | Pull Through | Bench Press |
| Single Leg Stability Chop | Resisted Lateral Lunge | Bent Over Row |
| Single Leg Stability Lift | Resisted Step Up | Chinup |
| Standing Pallof Press | Single Arm, Single Leg RDL | Front Raise |
| Tall Kneeling Pallof Press | Single Leg RDL | Hammer Curl |
| Barbell Deadlift | Split Squat | Inline Chest Press |
| Barbell RDL | Sumo Deadlift | Inline Chop |
| Bulgarian Split Squat | ½ Kneeling Alternating Overhead Press | Inline Lift |
| Front Squat | ½ Kneeling Chop | Iso Split Squat Chest Press |
| Goblet Curtsey Lunge | ½ Kneeling Lift | Iso Split Squat Chop |
| Goblet Reverse | ½ Kneeling Overhead Press | Single Arm Chest Press |
| Iso Split Squat Lift | ½ Kneeling Single | Tall Kneeling Single Arm Lat |
| Lateral Raise | Single Leg Standing Chest Press | |
| Neutral Lat Pulldown | Single Leg | |

TABLE 1-continued

| Extrapolated movements available from seed movement. | | |
|---|---|---|
| Seated Lat Pulldown | Standing Lift | Pulldown |
| Seated Overhead Press | Standing Barbell Overhead Press | Tricep Extension |
| Seated Row | Standing Face Pull | Tricep Kickback |
| Single Arm Bench Press | Standing Incline Press | Upright Row |
| Single Arm Bent Over Row | Standing Overhead Press | X-Pulldown |
| Single Leg Chop | Supinated Curl | X-Pulldown w/ Tricep Extension |
| | Tall Kneeling | Y-Pull |

In one embodiment, a goal of the one or more isokinetic seed movements is to determine a user's FVP for a user's muscle group. As described above, with an FVP there are two estimations and/or determinations that may be made. First, the FVP in part determines a 1eRM. Second, recommended starting weights based on percentage 1eRM charts derived through accepted industry norms are available. Again, to be sure a user does not injure themselves on their first set of 10 reps, for example their 15 rep maximum weight is instead computed and recommended, wherein the 15 rep maximum weight is the weight at which a user may do 15 reps but not 16. This 15 rep maximum weight is determined from percentage 1eRM charts traditionally available.

For example, it is determined that a given user has a 1eRM of 50 lb using the machine in FIG. 1 and the technique described above with isokinetic seed movements. According to a traditional percentage 1eRM chart, a 10 rep max may use a weight equal to 75% of the 1eRM, or 37.51b. This may be too heavy as the user may only be able to complete a single set of 10 reps. Instead, an adjustment between 10-15% may be made. For example, if a 10% adjustment is made associated with a 15 rep max, then 75%-10%=65% of the 1eRM, which is 32.5 lb. The 10 rep suggestion than would be equivalent to the 15 rep max, producing the suggestion that a user do 32 lbs for 10 reps to start.

In one embodiment, determining a user's FVP for a user's muscle group is related to solving the isokinetic model:

$$F=B(t)\exp(-a(t)v)$$

wherein F and v are the produced force and movement speed, respectively.

There are at least three sets of information following from a user's FVP:

Strength Calibration—For a given movement and as described herein, given a FVP $a(t_i)$ at the range of motion given at time $t_i$ the value of $B(t_i)$ is solved for, which is the value of F at v=0, or the 1eRM;

Strength Typing—For a given movement, strength typing involves determining an FVP $a(t_i)$ at the range of motion given at time $t_i$ for a plurality of users. The predetermined FVP, or strength typing, may be established using a pool of users who perform the given movement one or more times and using linear regression and/or other statistical modeling techniques, including, for example, a higher order polynomial-based statistical analysis; and Force-Time Prediction—For a given movement, over a range of motion and/or over time t, both the 1eRM, or B, and LVP, or a, may vary. Force-time prediction analysis determines the corresponding variations over time and plots them as a function of index t. This in turn allows a tracking of translation and/or rotation of the actuator (110) to give coaching and correction to the user on form of an entire movement.

By isolating a force-range of motion curve as in force-time prediction, there are expected tension curves produced throughout ranges of motion. In one embodiment, capture technology including motion capture, force platforms, and inverse kinematics analysis enhances such analysis. In one embodiment, isolating these curves, parsing out sections of the range of motion to determine prime movement, and then implementing an adaptive training protocol to align those curves with expected training needed is performed. This also improves injury prediction.

Figure 3:
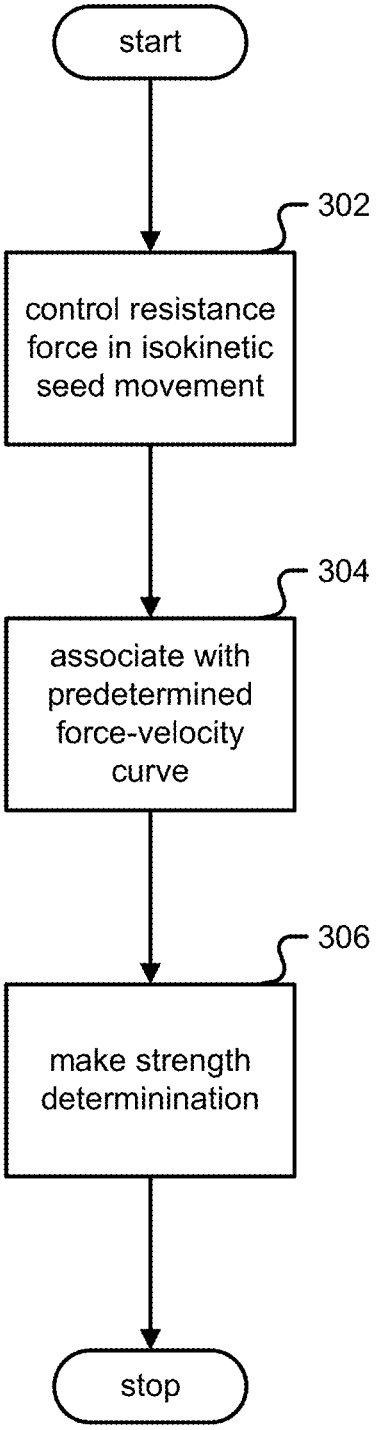
FIG. 3 is a flowchart illustrating an embodiment of a process for strength calibration.

FIG. 3 is a flowchart illustrating an embodiment of a process for strength calibration. In one embodiment, the motor controller (104) of FIG. 1 carries out the process of FIG. 3.

In step 302, a resistance force is controlled such that a user's effort against the resistance force results in a first isokinetic seed movement, wherein the user is an exercise machine user using an exercise machine.

In step 304, the resistance force required to effect the first isokinetic seed movement is associated with a predetermined FVP. In step 306, a strength determination of the user is made based at least in part on the required resistance force and the associated predetermined FVP.

In one embodiment, the strength determination comprises a one rep max. In one embodiment, the one rep max corresponds to a point along the force-velocity profile with a zero velocity. In one embodiment, the resistance force is along a cable. In one embodiment, the predetermined force-velocity profile is based on previous measurements of a plurality of test subjects. In one embodiment, the strength determination of the user corresponds to a specific exercise and/or muscle group.

In one embodiment, each isokinetic seed movement comprises using the exercise machine, for example the one in FIG. 1, to dynamically change resistance to match the user's applied force, while allowing the user to move the resistance at a prescribed constant speed during a concentric phase. In one embodiment, the prescribed constant speed is between 20 and 60 inches per second.

Figure 4:
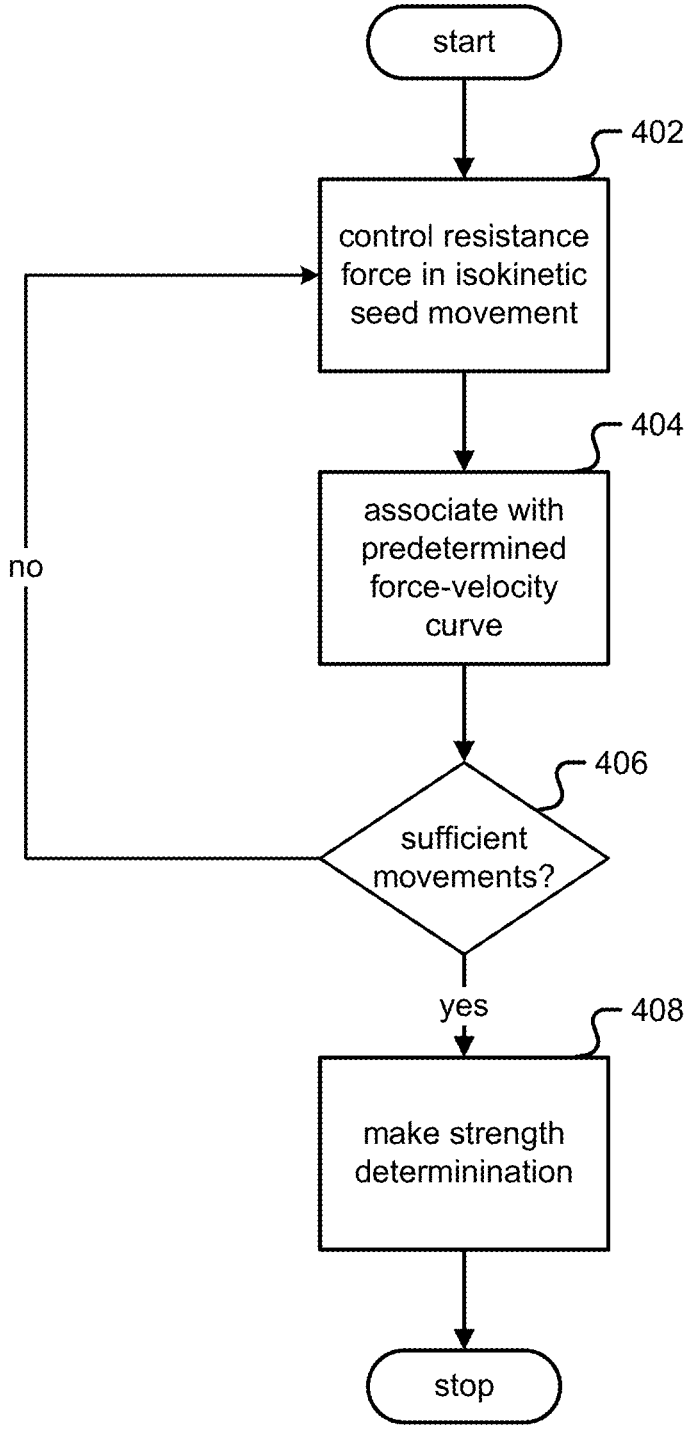
FIG. 4 is a flowchart illustrating an embodiment of a process for strength calibration using multiple reps.

FIG. 4 is a flowchart illustrating an embodiment of a process for strength calibration using multiple reps. That is, it expands upon the process of FIG. 3 with additional data points from additional isokinetic seed movements.

Similar to step 302, in step 402 a resistance force is controlled such that a user's effort against the resistance force results in a first isokinetic seed movement, wherein the user is an exercise machine user using an exercise machine. Similar to step 304, in step 404 the resistance force required to effect the first isokinetic seed movement is associated with a predetermined FVP.

If it is determined that there are not yet sufficient movements taken in step 406, the process repeats steps 402 and 404 for a second, third, and/or fourth isokinetic seed movement. In step 408, a strength determination of the user is made based at least in part on the plurality of movements in steps 402-406. In one embodiment, speed is dropped between the first resistance force and the second resistance force.

There may be at least three reasons to take a plurality of isokinetic seed movements. In a first embodiment, a "best" isokinetic seed movement from the first isokinetic seed movement, second isokinetic seed movement, and third isokinetic seed movement is used in making the strength determination, for example if the plurality of isokinetic seed movements were taken of the same type of movement, for example a pushing upper body movement, and at the same speed.

In a second embodiment, a plurality of isokinetic seed movements are used to determine strength for a given movement, for example if the plurality of isokinetic seed movements were taken of the same type of movement, for example a pushing upper body movement, but at different speeds.

In a third embodiment, a plurality of isokinetic seed movements are used to determine an overall set of strength levels for different muscle groups for one use, for example if the plurality of isometric seed movements were taken of different types of movement, for example a pushing upper body movement, a core movement, a pushing upper body movement, and a lower body movement. In one embodiment, each isokinetic seed movement comprises at least one of the following: a seated lat pulldown, a seated overhead press, a bench press, and a neutral grip deadlift.

In one embodiment, in step 408 the strength determination of the user is extended and/or extrapolated to a second exercise, for example those in Table 1.

In one embodiment, the strength determination comprises a recommended starting weight for multiple repetitions of a first non-isokinetic seed movement associated with the first isokinetic seed movement. In one embodiment, the strength determination further comprises a recommended starting weight for multiple repetitions of another non-isokinetic seed movement.

Figure 5:
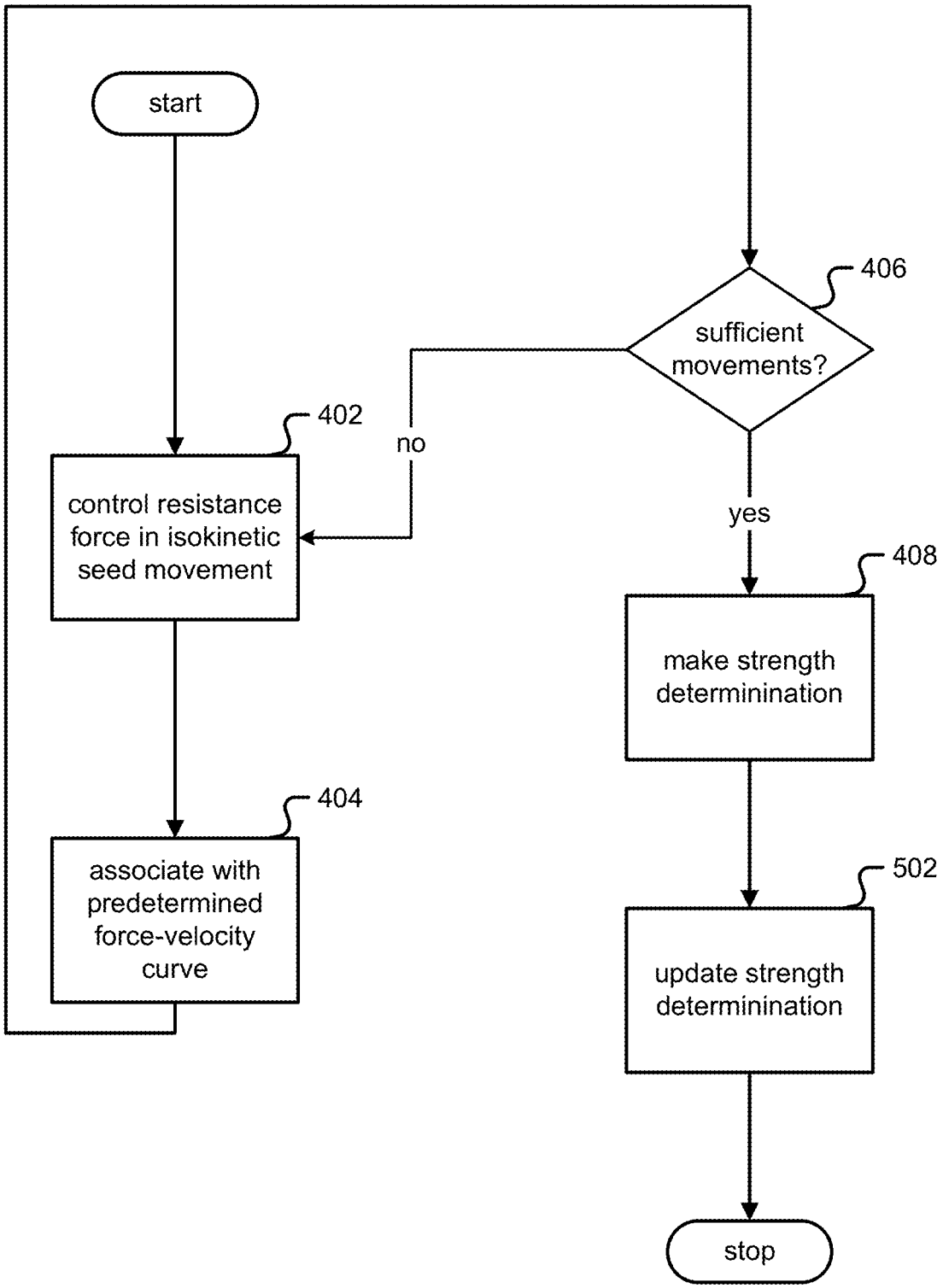
FIG. 5 is a flowchart illustrating an embodiment of a process for strength determination and updates.

FIG. 5 is a flowchart illustrating an embodiment of a process for strength determination and updates. That is, it expands upon the process of FIG. 4 with the same steps 402, 404, 406, and 408, with an additional step 502. In step 502, the strength determination is updated based at least in part on user performance on a non-isokinetic seed movement.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine, comprising:

a processor configured to:

control a resistance force such that a user's effort against the resistance force results in a first isokinetic seed movement;

associate the resistance force required to effect the first isokinetic seed movement with a force-velocity profile;

determine whether a sufficient number of isokinetic seed movements have been performed by the user; and in response to a determination that the sufficient number of isokinetic seed movements have been performed by the user, make a strength determination of the user based on the isokinetic seed movements performed by the user; and a memory coupled to the processor and configured to provide the processor with instructions.

2. The exercise machine of claim 1, wherein the exercise machine is configured to be used by the user.

3. The exercise machine of claim 1, wherein the processor is configured to control the resistance force such that the user's effort against the resistance force results in one or more additional isokinetic seed movements in response to a determination that the sufficient number of isokinetic seed movements have not been performed by the user.

4. The exercise machine of claim 1, wherein the strength determination of the user is made based on a top isokinetic seed movement of the isokinetic seed movements performed by the user.

5. The exercise machine of claim 4, wherein the isokinetic seed movements performed by the user are a same isokinetic seed movement type.

6. The exercise machine of claim 5, wherein the same isokinetic seed movement type is performed at a same speed.

7. The exercise machine of claim 5, wherein the same isokinetic seed movement type is performed at different speeds.

8. The exercise machine of claim 1, wherein the isokinetic seed movements performed by the user are different isokinetic seed movement types.

9. The exercise machine of claim 8, wherein the isokinetic seed movements performed by the user are used to determine an overall set of strength levels for different muscle groups.

10. The exercise machine of claim 1, wherein the strength determination includes a recommended starting weight for multiple repetitions of a first non-isokinetic seed movement associated with the first isokinetic seed movement.

11. The exercise machine of claim 1, wherein the strength determination includes a one rep maximum.

12. The exercise machine of claim 11, wherein the one rep maximum corresponds to a point along the force-velocity profile with a close to zero velocity.

13. The exercise machine of claim 1, wherein each isokinetic seed movement of the isokinetic seed movements comprises at least one of the following: a lower body movement, a pushing upper body movement, a pulling upper body movement, and a core movement.

14. The exercise machine of claim 1, wherein the resistance force is along a cable.

15. The exercise machine of claim 1, wherein the force-velocity profile is based on previous measurements of a plurality of test subjects.

16. The exercise machine of claim 1, wherein the strength determination of the user corresponds to a specific exercise.

17. The exercise machine of claim 16, wherein the processor is further configured to extrapolate the strength determination of the user to a second exercise.

18. The exercise machine of claim 1, wherein each isokinetic seed movement of the isokinetic seed movements comprises using the exercise machine to dynamically change resistance to match the user's applied force, while allowing the user to move the resistance at a prescribed constant speed during a concentric phase.

19. A method, comprising:

controlling a resistance force such that a user's effort against the resistance force results in a first isokinetic seed movement;

associating the resistance force required to effect the first isokinetic seed movement, with a force-velocity profile;

determining whether a sufficient number of isokinetic seed movements have been performed by the user; and in response to determining that the sufficient number of isokinetic seed movements have been performed by the user, making a strength determination of the user based on the isokinetic seed movements performed by the user.

20. A computer program product, the computer program product being embodied in a non-transitory computer readable storage medium and comprising computer instructions for:

controlling a resistance force such that a user's effort against the resistance force results in a first isokinetic seed movement;

associating the resistance force required to effect the first isokinetic seed movement, with a force-velocity profile;

determining whether a sufficient number of isokinetic seed movements have been performed by the user; and in response to determining that the sufficient number of isokinetic seed movements have been performed by the user, making a strength determination of the user based on the isokinetic seed movements performed by the user.

* * * * *